US006616303B1

(12) United States Patent
Rosset

(10) Patent No.: US 6,616,303 B1
(45) Date of Patent: Sep. 9, 2003

(54) SEALED SPORTLIGHT

(76) Inventor: James Rosset, 18, chemin Petite-Garenne, CH-1214 Vernier (CH)

( * ) Notice: Subject to any disclaimer, the term of this patent is extended or adjusted under 35 U.S.C. 154(b) by 0 days.

(21) Appl. No.: 09/600,721

(22) PCT Filed: Jan. 21, 1999

(86) PCT No.: PCT/CH98/00019

§ 371 (c)(1),
(2), (4) Date: Sep. 15, 2000

(87) PCT Pub. No.: WO99/37950

PCT Pub. Date: Jul. 29, 1999

(51) Int. Cl.[7] ..... F21V 9/00; F21V 1/00

(52) U.S. Cl. ..... 362/293; 362/240; 362/560; 362/311; 362/267

(58) Field of Search ..... 362/293, 184, 362/240, 267, 311, 560

(56) References Cited

U.S. PATENT DOCUMENTS 5,580,156 A * 12/1996 Suzuki et al. ..... 362/184
5,597,231 A * 1/1997 Rosset ..... 362/231
5,651,606 A 7/1997 Krogman
5,651,608 A 7/1997 Wedell

FOREIGN PATENT DOCUMENTS

| | | | |
|---|---|---|---|
| DE | 9111528 | | 11/1991 |
| FR | 908257 | | 11/1946 |
| GB | 2056647 | | 3/1981 |
| GB | 2056647 A | * | 3/1981 |

* cited by examiner

*Primary Examiner*—Sandra O'Shea
*Assistant Examiner*—James W Cranson
(74) *Attorney, Agent, or Firm*—Ostrolenk, Faber, Gerb & Soffen, LLP

(57) ABSTRACT

A sealed flood light, for example, for use outdoors, comprises at least one series of three bulbs each of the three bulbs having a colored filter and an electrical supply in a sealed frame. The sealed flood light is capable of changing color by varying the intensity of each of the bulbs by regulating, independently, the electrical supply system of each of the bulbs, using a regulator, for example.

12 Claims, 1 Drawing Sheet

SEALED SPORTLIGHT

Figure 1:
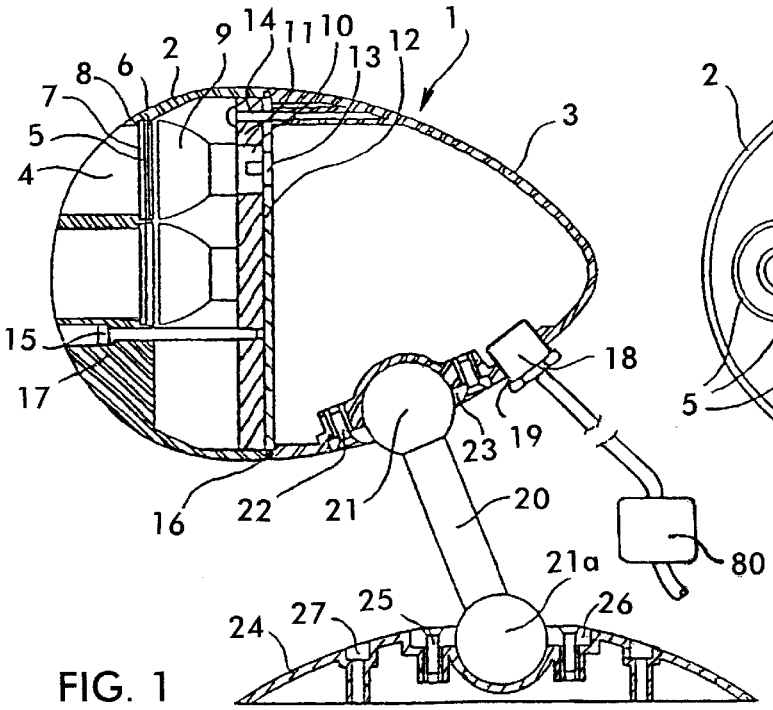

The present invention is in the field of lighting and relates more particularly to a sealed flood light, which can be used for example on an outdoor stage for shows. This floodlight is designed in such a way as to make it possible to change the color of the light emitted.

Various kinds of floodlights are known which are capable of shining a light beam which can be adjusted in intensity and which can be made to change color. This change of colour can be achieved using colored filters interposed in a beam of white light, which filters can be disposed in a ring or overlaid one above the other. It is also possible to carry out this change with an assembly of filters and of dichroic mirrors in the light beam. In practice all these systems with their advantages and drawbacks are more or less effective when they are working indoors. As soon as one wishes to use these unsealed floodlights outdoors it is necessary to find solutions for protecting them from bad weather without impairing performance. If one has unsealed floodlights, they will certainly be limited in their steering movements on account of interference with the covers provided for their own protection.

French Patent FR 908.257 presents an apparatus intended for underwater searches and characterized by an underwater floodlight forming on entirely closed assembly, completely sealed, which effectively resists the pressure of the water, even at great depths, and exhibits great mechanical robustness.

American Patent U.S. Pat. No. 5,651,606 relates to an apparatus for outdoor use which consequently is exposed to inclement weather and which is used as a floodlight with high-intensity light and as a steerable floodlight for accentuating buildings and other constructions.

The present invention aims to alleviate these difficulties. It presents a sealed floodlight, which consequently can be subjected to inclement weather, which can change colours by reason of the assembly of filters available to it and of the independent electrical supply system for each of the bulbs which it comprises.

The subject of the present invention is a sealed floodlight comprising at least one series of three bulbs placed on a circle with their respective filters and their electrical supply system placed inside a frame in the form of a shell composed of two pieces, a front piece exhibiting a bore placed in front of each bulb and closed by a glass pane secured to this front piece and another rear piece, the two pieces being joined by way of an O-ring seal; a gland being placed on the rear piece of the shell allows the passage of cables for supplying the electrical system, exhibiting a fixing rod, characterized in that it comprises a central bulb which emits yellow or white colored light, the light beams emitted by the bulbs and the central bulb being substantially parallel.

In a preferred mode of execution the filters relating to the bulbs are alternately red, green and blue. In this mode of execution, the floodlight can advantageously contain two series of three bulbs whose filters are slightly more tinted from one series to the other. These filters are placed behind the glass panes between the glass panes and each bulb so that the light beams are coloured.

The clamping of the two pieces of the shell is advantageously effected with fixing screws which collaborate to press the O-ring seal between the said pieces.

To facilitate the clamping on the inside the bulbs collaborate with their sockets which are housed in a bas which bears against a plate for separating two parts, the plate supported by the rear piece of the shell; the base and the plate are fixed by screws to the rear piece of the shell.

In one preferred embodiment the floodlight exhibits a compact shape; it can advantageously be an ovoid or a sphere.

It comprises a fixing rod with at its head a ball joint whose clamping is effected by means of the screws and of a round base which matches the shape of the ball joint.

In another mode of execution the electrical supply cables pass through the ball joint of the rod, thereby avoiding the need to have the gland in the rear part of the shell.

It is also possible to substitute the ball joint at the head of the rod with a screw and nut set together with a sealing collar.

The appended drawing represents by way of non-limiting example a preferred embodiment of the subject of the present invention as well as a variant to this first.

Figure 2:
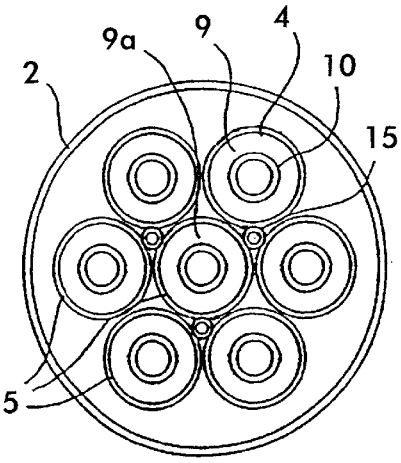
Figure 3:
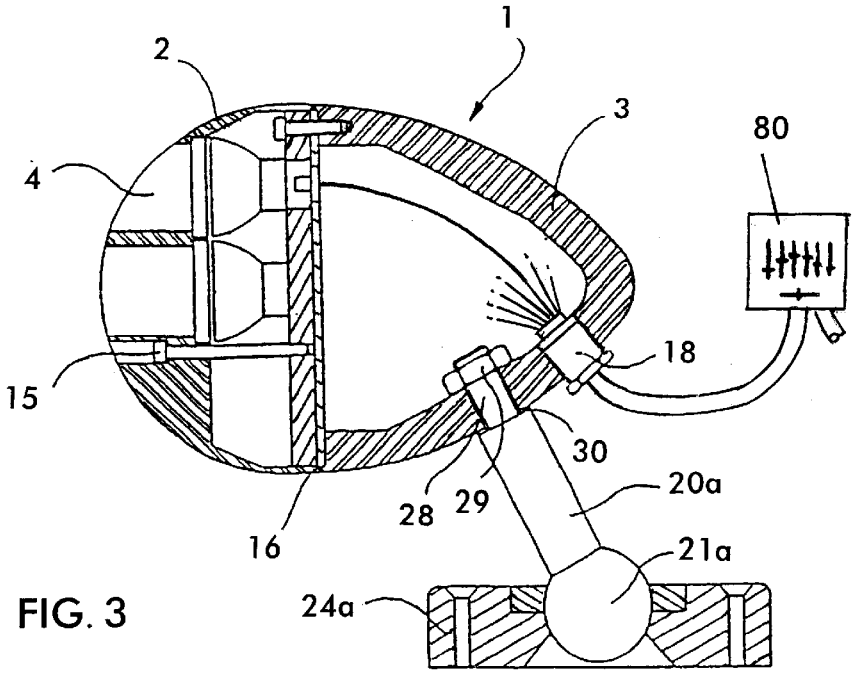

In the drawing,

FIG. 1 represents a longitudinal section through the floodlight, showing the layout of the main components in a variant with double-ball-joint rod, FIG. 2 is a front view of the floodlight with two times 3 white bulbs forming a circle and furnished with colour filters which are in front of the corresponding bulbs, this view shows us the presence of a central bulb, FIG. 3 represents another variant of a rod with a ball joint at one end and a screw and nut pair at the other.

In FIG. 1 the shell 1 is composed of two pieces, a front part 2 and a rear part 3. The front piece which houses in the bores 4 the colour filters 5, maintained by a spring collar 6 and of [sic] a sealed glass pane 7. The sealed glass panes 7 which serve to protect the filters 5 adhere to the front part 2 by the silicone glue seals 8. The filters 5 and the sealed glass panes 7 are on the axis of the bulbs 9. The bulbs 9 are supported by the pressure of the front part 2 and are plugged into the supply sockets 10. The supply sockets 10 are housed in a base 11 which matches their shapes, revealing only the electrical contacts for the power supply to the bulbs 9. At the rear of the base 11 is a plate 12 which makes it possible to hold the sockets 10 and to have them bear against the base 11. The plate 12 has a hole 13 on the axis of the socket 10 so as to allow the passage of the electric wires (not represented in the drawing). The screws 14 make it possible to hold the base 11 and the plate 12 against the rear part 3. The front part 2 is held against the rear part 3 by the tightening of the screws 15 in the base 11. An O-ring seal 16 lies at the end and around the perimeter of the rear part 3. The O-ring seal 16 allows sealing between the front piece 2 and the rear piece 3. The front piece 2 squeezes the O-ring seal 16 against the rear part 3. The squeezing of the O-ring seal 16 is effected by the screws 15. There are collars 17 at the rear of the heads of the screws 15 for sealing the front piece 2. The collars 17 are squeezed by the tightening of the screws 15 against the front piece 2. On the rear piece 3 may be seen a sealed gland 18 which allows the passage of the electric cables for supplying the electric sockets 10. The sealed gland 18 is screwed into the rear part 3 and also comprises a collar 19 which allows the sealing of the gland 18 with the rear piece 3. The collar 19 is squeezed by the sealed gland 18 against the rear piece 3. A double-ball-joint rod 20 makes it possible to move the rear piece 3 along all the axes. This ball joint rod 20 similarly matches its housing in the piece 3. The clamping of the ball joint 21 is effected by screws 22 and a round base 23 which matches the shape of the ball joint 21. It is possible to have the electric cables pass through the rod 20 and its ball joints 21, 21*a* by so as to replace the use of the sealed gland 18. It should be noted that if the electric cables are passed through the rod 20 and its ball joints 21, 21*a*, it is essential to have a sealed device (not represented in the drawing) similar to the previous ones and which would allow the sealing of the ball joint 21 with the rear piece 3. At the other end of the rod the ball joint 21*a* is housed in the base 24 which makes it possible, in a similar manner to the rear piece 3, to be able to move the ball joint 21*a* in all the axes. The clamping of the ball joint 21*a* is effected by screws 25 which pass through the round collar 26 and the base 24 allow good clamping since they match the shape of the ball joint 21*a* perfectly. The holes 27 allow the base 24 to be fixed to a wall or any other flat surfaces. It is possible also to have a sealed device in the base 24 so as to allow the passage of the electric cables through the rod 20 and its ball joints 21, 21*a* which, once again, would avoid the use of the sealed gland 18.

In FIG. 2 we can appreciate a front view of the floodlight with the front part 2 and with the bulbs 9 on the axes of the bores 4 and which are in a configuration around a perimeter of a circle. The electric sockets 10 as well as the position of the filters 5 and the sealed glass panes 7 found in FIG. 1 can be defined on the same axes of the bores 4. Also apparent are the screws 15 which allow the clamping of the front part 2 against the rear part 3 as well as the central bulb 9*a*.

In FIG. 3, there is shown an alternative rod 20*a* whose upper head which collaborates with the rear piece 3 of the shell 1 is composed of a screw 28 with its nut 29. Tightening is achieved by the squeezing of a sealing collar 30. If one has this configuration of rod 20*a*, the steering of the floodlight must be done exclusively with the aid of the ball joint 21*a* housed in the base 24*a*.

Finally, the floodlight 1 composed of six bulbs 9 with their respective colour filters 5 and their individual supply systems makes it possible, with the collaboration of regulators 80 for varying the current, to adjust the luminous intensity of the beams which will pass through the filters 5 whose basic red, green and blue colours may have shades of tints. For example, if there are two sets of three red, green and blue filters, one set could be darker than the other, so that the floodlight can provide a very varied sample of colours. Mention should also be made of the additional brightness-increase effect afforded by the central bulb 9*a* which in the case specified has no filter.

What is claimed is:

1. A sealed floodlight comprising:

a shell including a front portion and a rear portion sealed to the front portion; holes through the front portion;

a set of bulbs comprising a first bulb, a second bulb and a third bulb in an array in the shell; an additional bulb emitting yellow or white light, wherein each of the bulbs is connected to a respective individual electrical power supply and each power supply is electrically connected to a regulator for individually adjusting the luminous intensity and each of the bulbs is positioned behind a respective hole in the front portion, each hole being sealed by a pane positioned in front of each of the bulbs;

a respective color filter in front of each of the bulbs of the set of bulbs and behind the pane;

whereby adjustment of the luminous intensity of each of the bulbs by controlling the regulator is capable of changing the color and intensity of the illumination from the floodlight.

2. The floodlight of claim 1, further comprising a sealed cable entry through the shell for sealing the entry of electric wires to the electric power supply.

3. The floodlight of claim 1, wherein the first, second and third bulbs are arrayed in a circle and the additional bulb is a central bulb in the circle.

4. The floodlight of claim 1, further comprising a fixing rod attached to the shell for supporting the shell.

5. The floodlight of claim 1, wherein the shell rear portion is sealed to the front portion with an O-ring seal.

6. The floodlight of claim 5, wherein the pane is sealed to the front portion using silicone glue.

7. The floodlight of claim 5, further comprising a sealed cable entry through the rear portion of the shell for sealing the entry of electric wires to the electric power supply.

8. The floodlight of claim 7, wherein the sealed cable entry comprises a packing gland on the rear portion of the shell.

9. The floodlight of claim 3, wherein the holes and panes are so disposed with respect to the bulbs that beams of light emitted by the bulbs are approximately parallel forward of the front portion of the shell.

10. The floodlight of claim 1, wherein the first, second and third filters are respectively red, green and blue.

11. The floodlight of claim 1, wherein the set of bulbs further comprises a fourth bulb, a fifth bulb and a sixth bulb, each having a respective filter that has a darker shade of color than the color of the respective filter for the first bulb, the second bulb and the third bulb.

12. The floodlight of claim 1, wherein the filter for each bulb is placed behind the lens for each bulb and the bulb.

* * * * *

UNITED STATES PATENT AND TRADEMARK OFFICE

CERTIFICATE OF CORRECTION

PATENT NO. : 6,616,303 B1
DATED : September 9, 2003
INVENTOR(S) : James Rosset

It is certified that error appears in the above-identified patent and that said Letters Patent is hereby corrected as shown below:

Title page,
Item [22], should read -- PCT Filed: January 21, 1998 --

Signed and Sealed this

Thirtieth Day of December, 2003

JAMES E. ROGAN
*Director of the United States Patent and Trademark Office*